US010362398B2

(12) United States Patent
Sondergaard

(10) Patent No.: US 10,362,398 B2
(45) Date of Patent: Jul. 23, 2019

(54) MONOLITHIC LOUDSPEAKER AND CONTROL METHOD THEREOF

(71) Applicant: Goertek, Inc., Shandong (CN)

(72) Inventor: Morten Birkmose Sondergaard, Hillerod (DK)

(73) Assignee: Goertek, Inc., Shandong (CN)

( * ) Notice: Subject to any disclaimer, the term of this patent is extended or adjusted under 35 U.S.C. 154(b) by 0 days.

(21) Appl. No.: 15/985,689

(22) Filed: May 21, 2018

(65) Prior Publication Data

US 2018/0359567 A1 Dec. 13, 2018

Related U.S. Application Data

(63) Continuation of application No. PCT/CN2017/088760, filed on Jun. 16, 2017.

(30) Foreign Application Priority Data

Jun. 12, 2017 (CN) ..... 2017 1 0439850

(51) Int. Cl.
*H04R 5/04* (2006.01)
*H04R 5/02* (2006.01)
(Continued)

(52) U.S. Cl.
CPC ..... *H04R 5/02* (2013.01); *H04R 1/24* (2013.01); *H04R 1/403* (2013.01); *H04R 5/04* (2013.01)

(58) Field of Classification Search
CPC ..... H04R 1/26; H04R 1/323; H04R 1/403; H04R 3/14; H04R 5/02
(Continued)

(56) References Cited

U.S. PATENT DOCUMENTS 6,694,037 B1 * 2/2004 Robinson ..... H04R 7/18 381/398
8,175,304 B1 * 5/2012 North ..... H04R 1/403 381/17

(Continued)

FOREIGN PATENT DOCUMENTS

CN 101431710 A 5/2009
CN 101610438 A 12/2009

(Continued)

OTHER PUBLICATIONS

International Search Report and Written Opinion, PCT/CN2017/088760, dated Feb. 26, 2018 (11 pages).

*Primary Examiner* — Melur Ramakrishnaiah
(74) *Attorney, Agent, or Firm* — Patent Law Works LLP

(57) ABSTRACT

A monolithic loudspeaker and a method for controlling a monolithic loudspeaker are disclosed. The loudspeaker comprises: a first pair of speakers for a first channel, including a first front speaker and a first rear speaker, wherein the first front speaker and the first rear speaker are arranged along a first axis in a first cross-section of the loudspeaker, and are arranged towards opposite directions; and a second pair of speakers for a second channel, including a second front speaker and a second rear speaker, wherein the second front speaker and the second rear speaker are arranged along a second axis in a second cross-section of the loudspeaker, and are arranged towards opposite directions; wherein the first axis and the second axis are deflected by an angle. According to an embodiment of this invention, a new arrangement for a monolithic loudspeaker is proposed.

13 Claims, 5 Drawing Sheets

(51) Int. Cl.
*H04R 1/40* (2006.01)
*H04R 1/24* (2006.01)

(58) Field of Classification Search
USPC ..... 381/300, 303, 332, 71.8, 89
See application file for complete search history.

(56) References Cited

U.S. PATENT DOCUMENTS

| | | | | |
|---|---|---|---|---|
| 2016/0219368 | A1* | 7/2016 | Goller ..... | H04R 1/26 |
| 2016/0286306 | A1* | 9/2016 | Fincham ..... | H04S 1/002 |

FOREIGN PATENT DOCUMENTS

| | | | |
|---|---|---|---|
| CN | 105706461 | A | 6/2016 |
| CN | 206004886 | U | 3/2017 |
| WO | 2012094576 | A1 | 7/2012 |

* cited by examiner

MONOLITHIC LOUDSPEAKER AND CONTROL METHOD THEREOF

CROSS-REFERENCE TO RELATED APPLICATIONS

This application is a continuation of International Application No. PCT/CN2017/088760, filed on Jun. 16, 2017, which claims priority to Chinese Patent Application No. 201710439850.5, filed on Jun. 12, 2017, both of which are hereby incorporated by reference in their entireties.

FIELD OF THE INVENTION

The present invention relates to the technical field of speaker, and more specifically, to a monolithic loudspeaker and a method for controlling a monolithic loudspeaker.

BACKGROUND OF THE INVENTION

In the prior art, technicians have developed many forms of loudspeakers.

One of the most interesting forms of a loudspeaker is that of a moderately-sized cylinder. It is generally 60~110 mm in diameter and is 240~450 mm in height. This kind of loudspeaker is generally called as a monolithic loudspeaker. For example, it may serve as a voice and audio interface to an artificial-intelligence personal assistant. In addition to providing interactive voice assistant services, the monolithic loudspeaker may also be used as music and other media playback device.

Unfortunately, due to the monolithic nature of such a device, it is poorly suitable to provide a good stereophonic experience, as is achieved by a typical, separated pair of loudspeakers. In the typical, separated pair of loudspeakers, 'left' and 'right' sound channels are fed to the separated loudspeakers. The separated loudspeakers are located at different places and thus emanate a stereo sound field for a listener.

In a traditional monolithic loudspeaker, separate beams of 'left' and 'right' sound channels are formed and are fed to a speaker array in the monolithic loudspeaker, so as to at least partially emulate the sound field emanated from a separated pair of loudspeakers. However, this approach does not work well, especially at the lower range of the audible frequency range. For example, in the lower range, the high wavelength-to-array-length ratio for the monolithic loudspeaker will result in a very high "White Noise Gain". This will lead to a very low efficiency.

Therefore, there is a demand in the art that a new solution for a monolithic loudspeaker shall be proposed to address at least one of the problems in the prior art.

SUMMARY OF THE INVENTION

One object of this invention is to provide a new technical solution for a monolithic loudspeaker.

According to an embodiment, there is provided a monolithic loudspeaker, comprising: a first pair of speakers for a first channel, including a first front speaker and a first rear speaker, wherein the first front speaker and the first rear speaker are arranged along a first axis in a first cross-section of the loudspeaker, and are arranged towards opposite directions; and a second pair of speakers for a second channel, including a second front speaker and a second rear speaker, wherein the second front speaker and the second rear speaker are arranged along a second axis in a second cross-section of the loudspeaker, and are arranged towards opposite directions; wherein the first axis and the second axis are deflected by an angle.

Alternatively or optionally, the angle is right angle.

Alternatively or optionally, the first and second pairs of speakers are low frequency speakers in a frequency below 2 KHz.

Alternatively or optionally, the loudspeaker further comprises additional speakers for producing a sound above 2 KHz.

Alternatively or optionally, a signal applied to the first rear speaker is delayed from that applied to the first front speaker to form a radiation pattern for the first channel, and wherein a signal applied to the second rear speaker is delayed from that applied to the second front speaker to form a radiation pattern for the second channel.

Alternatively or optionally, the delayed signals are used to produce a sound in a range of 250 Hz to 2 KHz.

Alternatively or optionally, a monaural signal is applied to the first and second pairs of speakers to produce a sound below 250 Hz.

Alternatively or optionally, the speakers have hyperbolic paraboloid diaphragms.

Alternatively or optionally, the first and second axes go through the center of the first and second cross-sections, respectively.

Alternatively or optionally, the first and second cross-sections are in a same plane.

Alternatively or optionally, the first channel is right channel and the second channel is left channel.

Alternatively or optionally, a shape of the loudspeaker is cylinder, the diameter of the cylinder is 60~110 mm, and the height of the cylinder is 240~450 mm.

According to an embodiment, there is provided a method for controlling a monolithic loudspeaker, comprising: arranging a first pair of speakers for a first channel and a second pair of speakers for a second channel, wherein a first front speaker and a first rear speaker of the first pair are arranged along a first axis in a first cross-section of the loudspeaker and face opposite directions, a second front speaker and a second rear speaker of the second pair are arranged along a second axis in a second cross-section of the loudspeaker and face towards opposite directions; applying a first pair of signals to the first rear speaker and the first front speaker, which form a desired sound radiation pattern for the first channel; applying a second pair of signals to the second rear speaker and the second front speaker, which form a desired sound radiation pattern for the second channel.

Alternatively or optionally, the first axis and the second axis are deflected by an angle.

Alternatively or optionally, the angle is right angle.

Alternatively or optionally, the first and second pairs of speakers are low frequency speakers in a frequency below 2 KHz.

Alternatively or optionally, the loudspeaker further comprises additional speakers for producing a sound above 2 KHz.

Alternatively or optionally, a signal in the first pair of signals applied to the first rear speaker is delayed from that applied to the first front speaker to form a radiation pattern for the first channel, and a signal applied to the second rear speaker is delayed from that applied to the second front speaker to form a radiation pattern for the second channel.

Alternatively or optionally, the delayed signals are used to produce a sound in a range of 250 Hz to 2 KHz.

Alternatively or optionally, a monaural signal is applied to the first and second pairs of speakers to produce a sound below 250 Hz.

Alternatively or optionally, the speakers have hyperbolic paraboloid diaphragms.

Alternatively or optionally, the first and second axes go through the center of the first and second cross-sections, respectively.

Alternatively or optionally, the first and second axes are in a same plane.

Alternatively or optionally, the first channel is right channel and the second channel is left channel.

Alternatively or optionally, a shape of the loudspeaker is cylinder, the diameter of the cylinder is 60~110 mm, and the height of the cylinder is 240~450 mm.

According to an embodiment of this invention, a new arrangement for a monolithic loudspeaker is proposed. Further features of the present invention and advantages thereof will become apparent from the following detailed description of exemplary embodiments according to the present invention with reference to the attached drawings.

BRIEF DESCRIPTION OF THE DRAWINGS

The accompanying drawings, which are incorporated in and constitute a part of the specification, illustrate embodiments of the invention and, together with the description thereof, serve to explain the principles of the invention.

DETAILED DESCRIPTION OF THE EMBODIMENTS

Figure 1:
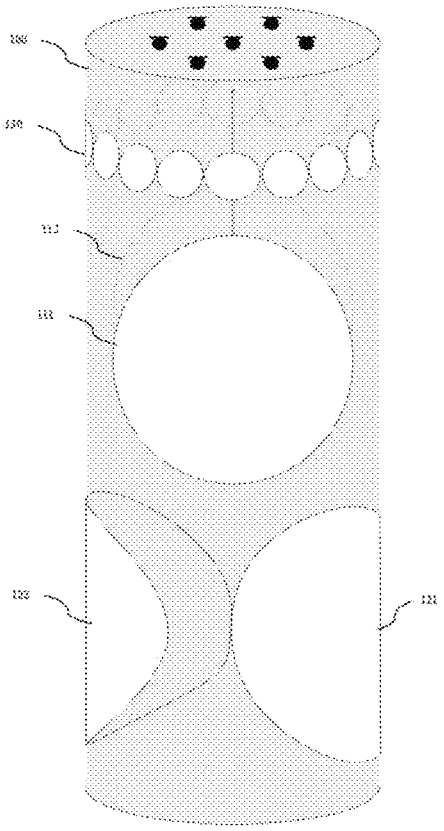
FIG. 1 shows a schematic diagram of a monolithic loudspeaker according to an embodiment.

Various exemplary embodiments of the present invention will now be described in detail with reference to the drawings. It should be noted that the relative arrangement of the components and steps, the numerical expressions, and numerical values set forth in these embodiments do not limit the scope of the present invention unless it is specifically stated otherwise.

The following description of at least one exemplary embodiment is merely illustrative in nature and is in no way intended to limit the invention, its application, or uses.

Techniques, methods and apparatus as known by one of ordinary skill in the relevant art may not be discussed in detail but are intended to be part of the specification where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed for following figures.

FIG. 1 shows a schematic diagram of a monolithic loudspeaker 100 according to an embodiment.

As shown in FIG. 1, the shape of the monolithic loudspeaker 100 is cylinder. The diameter of the cylinder can be 60~110 mm, and the height of the cylinder can 240~450 mm. Although the monolithic loudspeaker 100 is show as such in FIG. 1, it shall be appreciated by a person skilled in the art that the shape of the loudspeaker is not limited to cylinder and it can be other shape such as cube, pyramid and so on.

The loudspeaker 100 includes a first pair of speakers for a first channel and a second pair of speakers for a second channel. For example, the first channel is right sound channel and the second channel is left sound channel.

The first pair of speakers includes a first front speaker 111 and a first rear speaker 112. The second pair of speakers includes a second front speaker 121 and a second rear speaker 122. Here, a front speaker means one towards a listener, and a rear speaker means one opposite to the listener. The speaker is a device, which can produce audible sounds for a listener.

The first front speaker 111, the first rear speaker 112, the second front speaker 121 and the second rear speaker 122 can be same or different.

Figure 2:
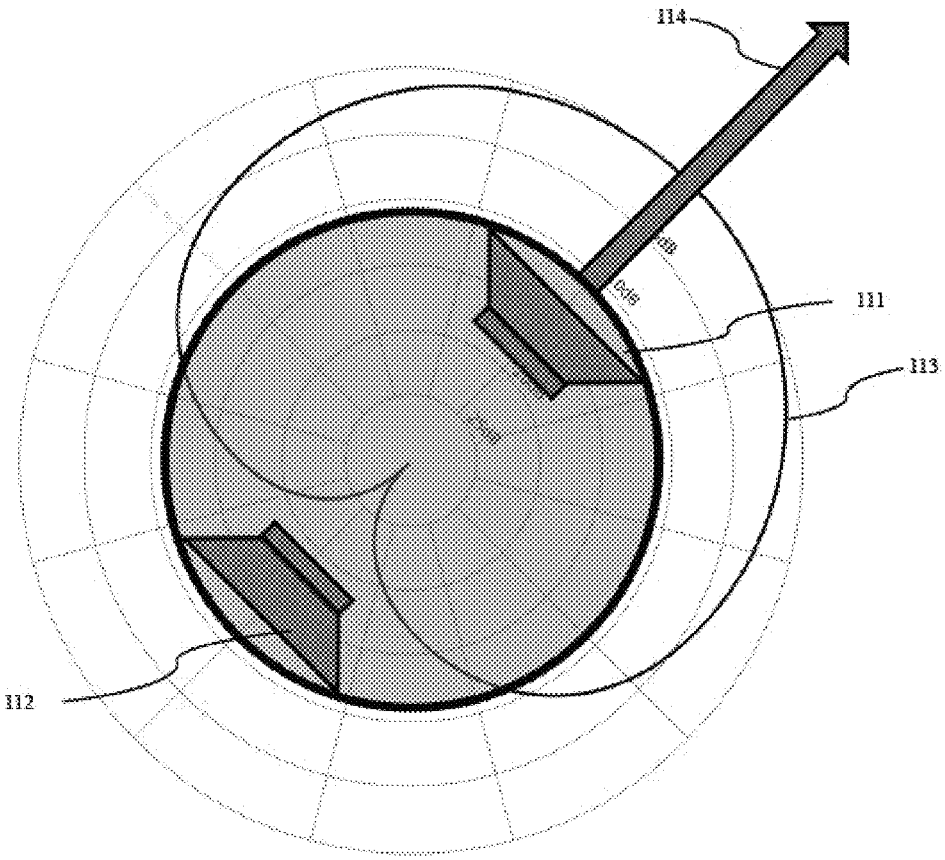
FIG. 2 shows a schematic diagram of a radiation pattern of right channel of the monolithic loudspeaker in a cross-section plane according to an embodiment.
Figure 3:
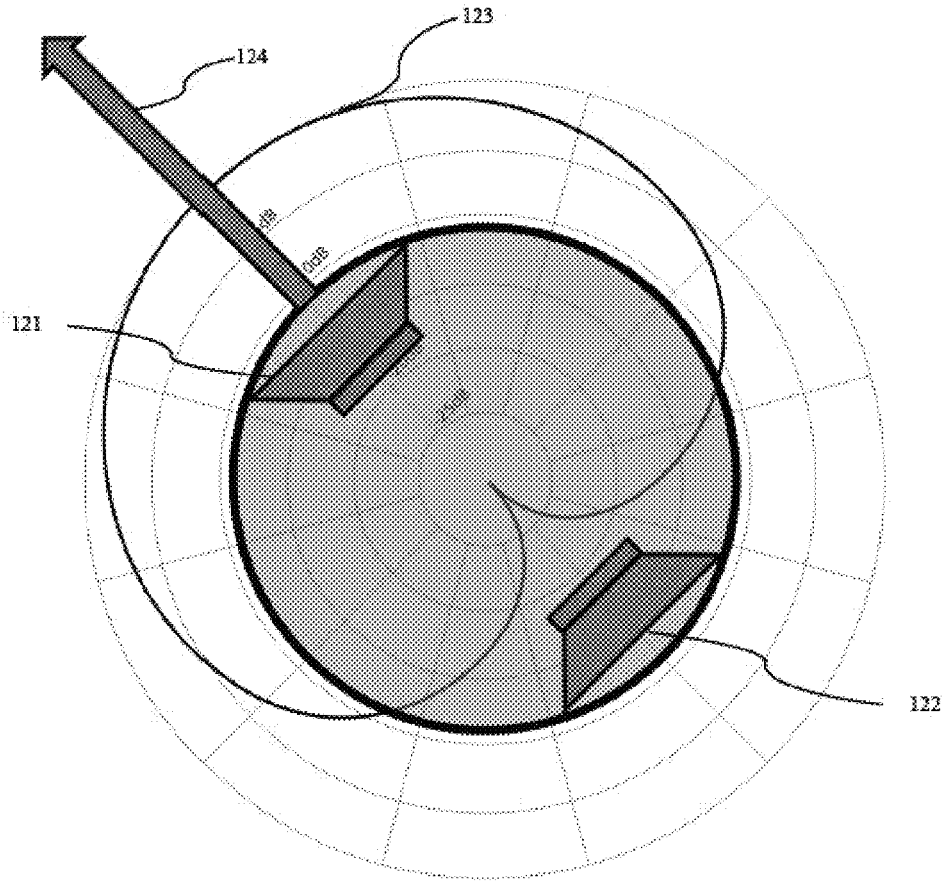
FIG. 3 shows a schematic diagram of a radiation pattern of left channel of the monolithic loudspeaker in a cross-section plane according to an embodiment.
Figure 4:
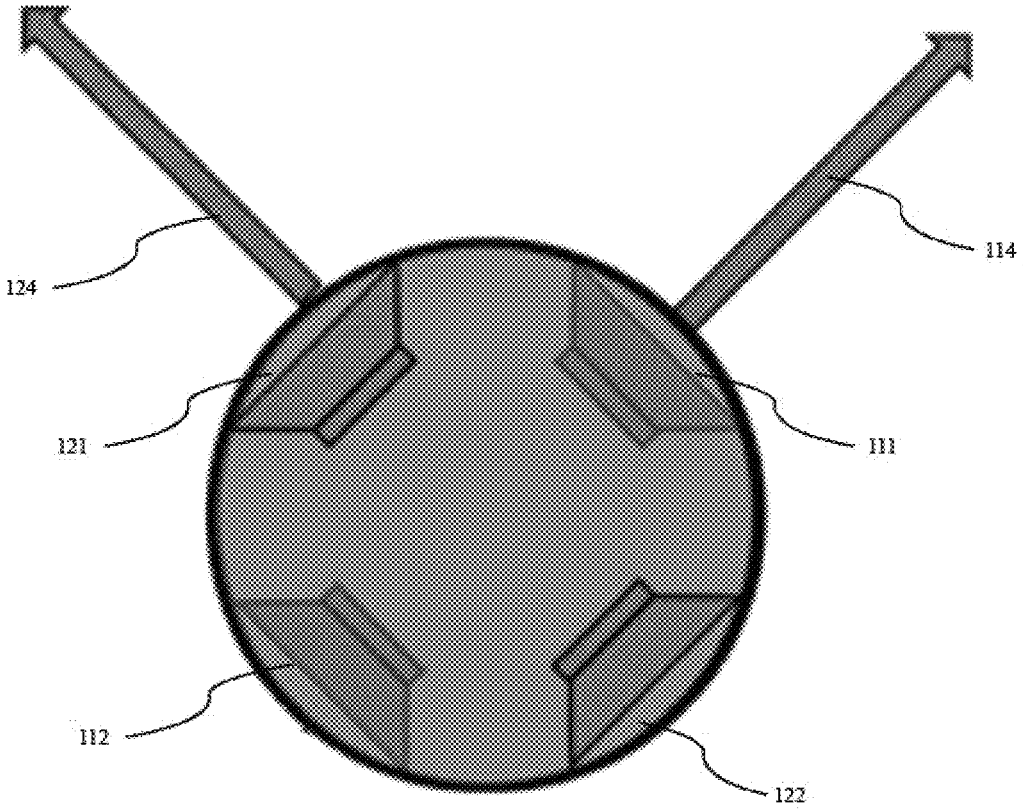
FIG. 4 schematically shows the arrangement of the two pairs of speakers.

FIG. 2 shows a schematic diagram of a radiation pattern of right sound channel of the monolithic loudspeaker in a cross-section plane according to an embodiment. FIG. 3 shows a schematic diagram of a radiation pattern of left sound channel of the monolithic loudspeaker in a cross-section plane according to an embodiment. FIG. 4 schematically shows the arrangement of the two pairs of speakers.

As shown in FIG. 2, the first front speaker 111 and the first rear speaker 112 are arranged along a first axis 114 in a first cross-section of the loudspeaker 100. For example, the center of the first front speaker 111 and the first rear speaker 112 are in the first axis 114. The first front speaker 111 and the first rear speaker 112 are arranged towards opposite directions. For example, the first front speaker 111 and the first rear speaker 112 may be placed outwards, transmitting sound to the outer space.

As shown in FIG. 3, the second front speaker 121 and the second rear speaker 122 are arranged along a second axis 124 in a second cross-section of the loudspeaker 100. For example, the center of the second front speaker 121 and the second rear speaker 122 are in the second axis 124. The second front speaker 121 and the second rear speaker 122 are arranged towards opposite directions. For example, the second front speaker 121 and the second rear speaker 122 may be placed outwards, transmitting sound to the outer space.

As shown in FIG. 4, the first axis 114 and the second axis 124 are deflected by an angle. By such an arrangement, it is easy to set the radiation patterns for the first and second channels, such as right and left channels, so as to provide a stereo sensation to a listener. Preferably, the angle is right angle (i.e. the first axis 114 and the second axis 124 are orthogonal), so that the direction discrimination will be maximized.

Since it is difficult for a traditional monolithic loudspeaker to provide a stereo sound field at low frequency because of the high wavelength-to-array-length ratio, this embodiment will be especially advantageous at such a frequency. For example, the first and second pairs of speakers are low frequency speakers in a frequency below 2 KHz, preferably, below 1 KHz. In FIG. 1, the loudspeaker 100 can further comprise additional speakers 130 for producing a sound above 2 KHz.

By using such an arrangement, many approaches can be used to do a beam-forming for a channel. Preferably, a delay approach is adopted, in which a signal delay is applied to a rear speaker so that a directional radiation pattern is formed. The radiation pattern is achieved by adding a delay in the signal path of the rear speaker in each pair.

FIG. 2 shows a radiation pattern for a right channel. In the embodiment of FIG. 2, a signal applied to the first rear speaker 112 is delayed from that applied to the first front speaker 111 to form a radiation pattern 113 for the first channel. For example, a delay is added to the signal path for the first rear speaker 112.

FIG. 3 shows a radiation pattern for a left channel. In the embodiment of FIG. 3, a signal applied to the second rear speaker 122 is delayed from that applied to the second front speaker 121 to form a radiation pattern 123 for the second channel. For example, a delay is added to the signal path for the second rear speaker 122.

In the radiation patterns 113, 123, a "null" is formed at the rear side (i.e. the side of the first rear speaker 112 or the second rear speaker 122), and the front side (the side of the first front speaker 111 or the second front speaker 121) along the first or second axes 114, 124 has the highest sound output. In this manner, a listener will perceive a stereo sound field. The radiation patterns 113, 123 can be same or different.

Since human sense of spatial perception is minimal at very low frequencies, a monaural signal is applied to the first and second pairs of speakers to produce a sound below 250 Hz. For example, below 250 Hz all 4 speakers play a same signal in mono. In this manner, sounds of such low frequencies can be reproduced with a maximal efficiency.

In this regard, it is advantageous to use the above beam-forming for sound of frequencies from 250 Hz to 2 KHz. That is, the above delayed signals are used to produce a sound in a range of 250 Hz to 2 KHz.

In an example, the speakers 111, 112, 121, 122 have hyperbolic paraboloid diaphragms so as to have a vibrating surface as large as possible and increase the sound output at low frequencies. In this regard, the parts surrounding the diaphragm may also be hyperbolic paraboloid so as to accommodate the diaphragms.

As shown in FIGS. 2 and 3, the first and second axes 114, 124 go through the center of the first and second cross-sections of the loudspeaker 100, respectively.

As shown in FIG. 1, the first and second pairs of speakers are in different planes, i.e. the first and second axes 114, 124 are not in the same level and are in different planes. However, the first and second axes can be placed in the same level. That is, the first and second cross-sections can be in the same plane.

In an embodiment, the two pairs of speakers can be used to achieve a 'first-order-gradient' radiating pattern, especially for middle and/or middle-low frequencies. The two pairs of speakers can be deflected by an angle. As shown in FIG. 2 and FIG. 3, each pair speakers can be used to steer a 'null' pattern, (i.e. a direction from which there is very little acoustic output). Such a steering is independent for each channel. That is, a steering for the left channel will be independent from that for the right channel. This will simplify the design of the loudspeaker which can provide a stereo sound field.

Furthermore, the arrangement of an embodiment will also enhance the stereo sound effect for lower frequencies. This will render an experience provided by a separated pair of loudspeakers.

By using a solution of an embodiment, an immersive stereo experience throughout a room can be produced from a single device.

Figure 5:
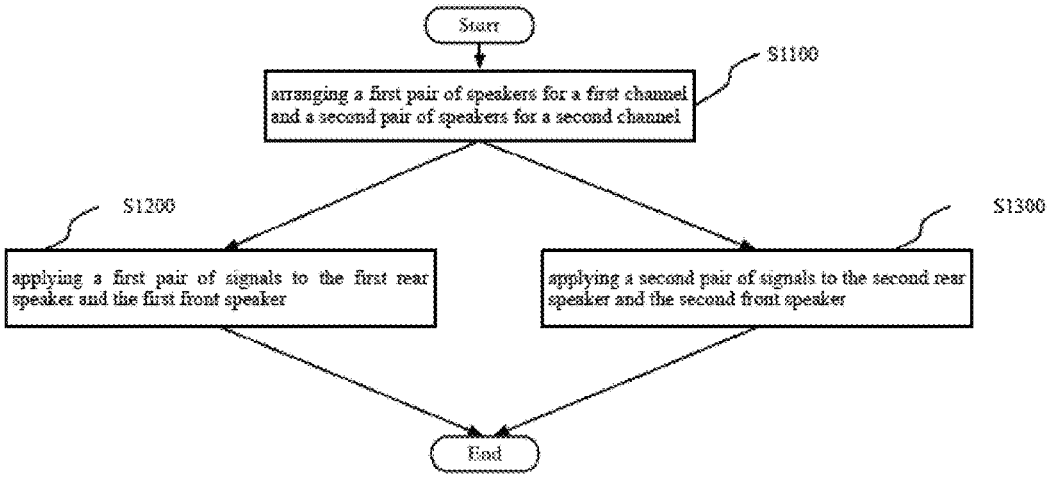
FIG. 5 shows a method for controlling the monolithic loudspeaker according to an embodiment.

FIG. 5 shows a method for controlling the monolithic loudspeaker according to an embodiment. The monolithic loudspeaker can be that described above.

As shown in FIG. 5, at step S1100, a first pair of speakers for a first channel and a second pair of speakers for a second channel are arranged. The first pair of speakers includes a first front speaker and a first rear speaker which are arranged along a first axis in a first cross-section of the loudspeaker and face opposite directions. The second pair of speakers includes a second front speaker and a second rear speaker which are arranged along a second axis in a second cross-section of the loudspeaker and face towards opposite directions. For example, the first axis and the second axis are deflected by an angle so that a spatial perception field is formed. Preferably, the angle is right angle.

Here, the first and second pairs of speakers may be low frequency speakers in a frequency below 2 KHz, and the loudspeaker may further comprise additional speakers for producing a sound above 2 KHz.

At step S1200, a first pair of signals are applied to the first rear speaker and the first front speaker. These signals will drive the speakers to form a desired sound radiation pattern for the first channel.

At step S1300, a second pair of signals to the second rear speaker and the second front speaker. These signals will drive the speakers to form a desired sound radiation pattern for the second channel.

In an example, a signal in the first pair of signals applied to the first rear speaker is delayed from that applied to the first front speaker to form a radiation pattern for the first channel, and a signal applied to the second rear speaker is delayed from that applied to the second front speaker to form a radiation pattern for the second channel. For example, the delayed signals are used to produce a sound in a range of 250 Hz to 2 KHz, and a monaural signal is applied to the first and second pairs of speakers to produce a sound below 250 Hz.

The specific method of each step can refer to the related contents in the above embodiments of the loudspeaker, and the repetitive description thereof will be omitted here.

Although some specific embodiments of the present invention have been demonstrated in detail with examples, it should be understood by a person skilled in the art that the above examples are only intended to be illustrative but not to limit the scope of the present invention.

What is claimed is:

1. A monolithic loudspeaker, comprising:

a first pair of speakers for a right channel, including a first front speaker and a first rear speaker, wherein the first front speaker and the first rear speaker are arranged along a first axis in a first cross-section of the loudspeaker, and are arranged towards opposite directions; and a second pair of speakers for a left channel, including a second front speaker and a second rear speaker, wherein the second front speaker and the second rear speaker are arranged along a second axis in a second cross-section of the loudspeaker, and are arranged towards opposite directions; wherein:

the first axis and the second axis are deflected by an angle;

a right channel signal applied to the first rear speaker is delayed from a right channel signal applied to the first front speaker to form a radiation pattern for the right channel;

a left channel signal applied to the second rear speaker is delayed from a left channel signal applied to the second front speaker to form a radiation pattern for the left channel;

the delayed right channel signal and the delayed left channel signal are used to produce a sound in a range of 250 Hz to 2 KHz; and a monaural signal is applied to the first and second pairs of speakers to produce a sound below 250 Hz.

2. The monolithic loudspeaker according to claim 1, wherein the angle is right angle.

3. The monolithic loudspeaker according to claim 1, wherein the first and second pairs of speakers are low frequency speakers in a frequency below 2 KHz; and the loudspeaker further comprises additional speakers for producing a sound above 2 KHz.

4. The monolithic loudspeaker according to claim 1, wherein the first and second pairs of speakers have hyperbolic paraboloid diaphragms.

5. The monolithic loudspeaker according to claim 1, wherein the first and second axes go through the center of the first and second cross-sections, respectively; and the first and second axes are in a same plane.

6. The monolithic loudspeaker according to claim 1, wherein a shape of the loudspeaker is cylinder, the diameter of the cylinder is 60~110 mm, and the height of the cylinder is 240~450 mm.

7. A method for controlling a monolithic loudspeaker, comprising:

arranging a first pair of speakers for a right channel and a second pair of speakers for a left channel, which comprising: arranging a first front speaker and a first rear speaker of the first pair along a first axis in a first cross-section of the loudspeaker to face opposite directions, arranging a second front speaker and a second rear speaker of the second pair along a second axis in a second cross-section of the loudspeaker to face towards opposite directions, and deflecting the first axis and the second axis by an angle;

applying a right channel signal to the first front speaker and a delayed right channel signal to the first rear speaker that is delayed from the right channel signal applied to the first front speaker, to form a radiation pattern for the right channel;

applying a left channel signal to the second front speaker and a delayed left channel signal to the second rear speaker that is delayed from the left channel signal applied to the second front speaker, to form a radiation pattern for the left channel, wherein the delayed right channel signal and the delayed left channel signal are used to produce a sound in a range of 250 Hz to 2 KHz; and applying a monaural signal to the first and second pairs of speakers to produce a sound below 250 Hz.

8. The method according to claim 7, wherein the angle is right angle.

9. The method according to claim 7, wherein the first and second pairs of speakers are low frequency speakers in a frequency below 2 KHz; and the loudspeaker further comprises additional speakers for producing a sound above 2 KHz.

10. The method according to claim 7, wherein the first and second pairs of speakers have hyperbolic paraboloid diaphragms.

11. The method according to claim 7, further comprising: making the first and second axes go through the center of the first and second cross-sections, respectively.

12. The method according to claim 7, further comprising: arranging the first and second axes in a same plane.

13. The method according to claim 7, wherein a shape of the loudspeaker is cylinder, the diameter of the cylinder is 60~110 mm, and the height of the cylinder is 240~450 mm.

* * * * *